United States Patent [19]

Brown

[11] 3,968,470

[45] July 6, 1976

[54] MAGNETIC MOTOR

[75] Inventor: Jack M. Brown, Costa Mesa, Calif.

[73] Assignee: Esterline Electronics Corporation, Costa Mesa, Calif.

[22] Filed: Mar. 13, 1975

[21] Appl. No.: 557,959

[52] U.S. Cl. ..... 335/230; 335/234

[51] Int. Cl.[2] ..... H01F 7/08

[58] Field of Search ..... 335/229, 230, 234, 276, 335/279

[56] References Cited

UNITED STATES PATENTS

| | | | |
|---|---|---|---|
| 3,116,481 | 12/1963 | Kalin et al. | 335/230 X |
| 3,317,871 | 5/1967 | Adams | 335/230 |
| 3,340,487 | 9/1967 | Gruner et al. | 335/279 X |

*Primary Examiner*—George Harris

*Attorney, Agent, or Firm*—Harvey C. Nienow

[57] ABSTRACT

A magnetic motor for use as an actuator for devices such as relays, indicators and the like.

It comprises an electromagnetic winding having a core member to the opposite ends of which are fastened pole pieces which cooperate with a magnetically movable armature. An additional pole piece as well as a permanent magnet are also provided.

One end of the armature is caused to contact or engage one of the pole pieces or, in the alternative, to engage or contact alternatively several different pole pieces. The opposite end of such armature is shaped so as to provide a generally U-shaped air gap with the other pole piece, and the armature is so positioned as to move from one side of coplanar relationship with such other pole piece to the other side thereof.

6 Claims, 5 Drawing Figures

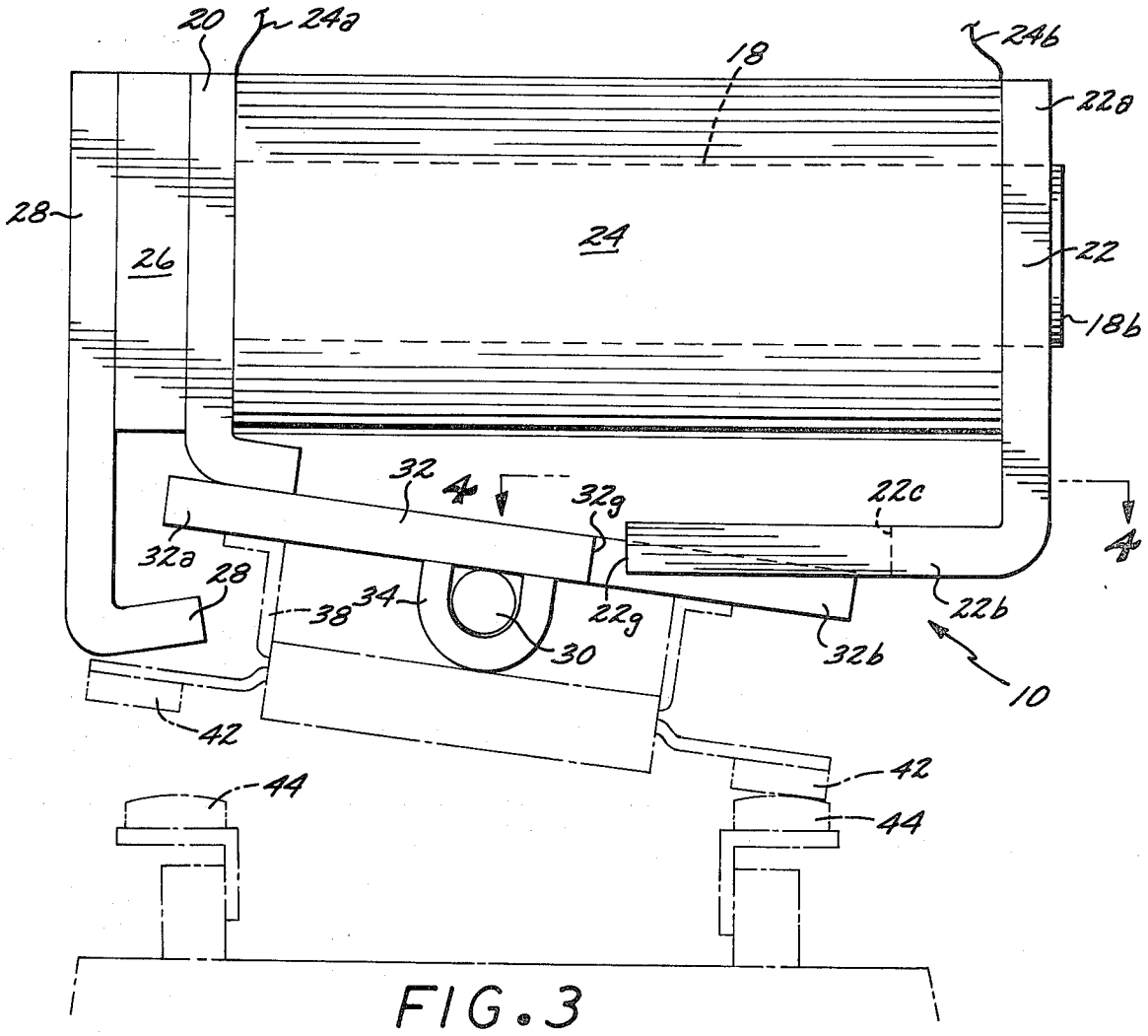
FIG. 3
FIG. 4
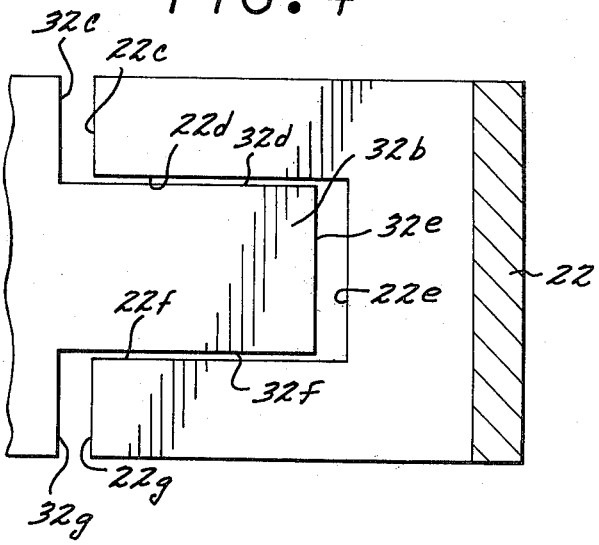
FIG. 5
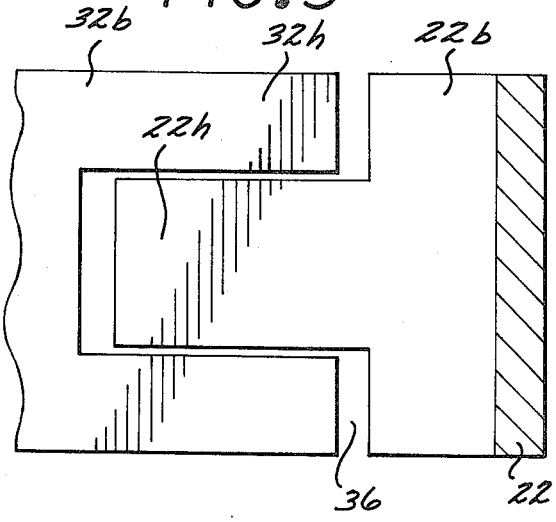

MAGNETIC MOTOR

The present invention relates generally to magnetic motors, and more particularly to such motors which are strong and effective in operating electrical relays, indicating devices and the like.

In the manufacture and assembly of magnetic motors, particularly for the operation of electromagnetic relays and the like, an attempt has been made to provide an armature the opposite ends of which engage a pair of relatively stationary pole pieces. That is, heretofore, such magnetic motors have comprised a pivotal armature in the magnetic circuit, which armature was required to simultaneously engage a pair of stationary pole pieces.

This was found to be virtually impossible of attainment due to the fact that it is difficult to locate the axis of rotation of the armature such that both armature end portions simultaneously engage their respective pole pieces.

It was found that even in the event such desired location was obtained, the desired operation was short-lived due to the normal wear of the various pivotal mounting members as well as the pole pieces and armature end portions. Thus, even though the desired simultaneous engagement of the armature with several pole pieces was obtained, after a relatively few number of operations, such ideal conditions were no longer present.

It is an object of the present invention to provide a magnetic motor wherein a predetermined air gap is employed between one armature end portion and its pole piece to obtain controlled magnetic strength therebetween.

Another object of the present invention is to provide a magnetic motor as characterized above wherein minimum wear is encountered of the various parts so that the initial settings and adjustments are maintained over a longer period of time.

A still further object of the present invention is to provide a magnetic motor as characterized above wherein the movable armature has two opposite operating positions and wherein substantially equal magnetic strengths are obtained thereat.

An even further object of the present invention is to provide a magnetic motor as characterized above wherein the air gap between one end portion of the armature and its pole piece is controlled precisely.

An even still further object of the present invention is to provide a magnetic motor as characterized above which is less susceptible to wear from magnetic particulate contamination during the life of the motor.

Another object of the present invention is to provide a magnetic motor as characterized above which is simple and inexpensive to manufacture and which is rugged and dependable in operation.

The novel features which I consider characteristic of my invention are set forth with particularity in the appended claims. The device itself, however, both as to its organization and mode of operation, together with additional objects and advantages thereof, will best be understood from the following description of specific embodiments when read in connection with the accompanying drawings, in which:

FIG. 3 is a side elevational view similar to FIG. 2, showing the relay in another operating position;

FIG. 4 is a fragmentary sectional view taken substantially along line 4—4 of FIG. 3;

FIG. 5 is a fragmentary sectional view of a second embodiment of the instant invention.

Like reference characters indicate corresponding parts throughout the several views of the drawings.

Figure 1:
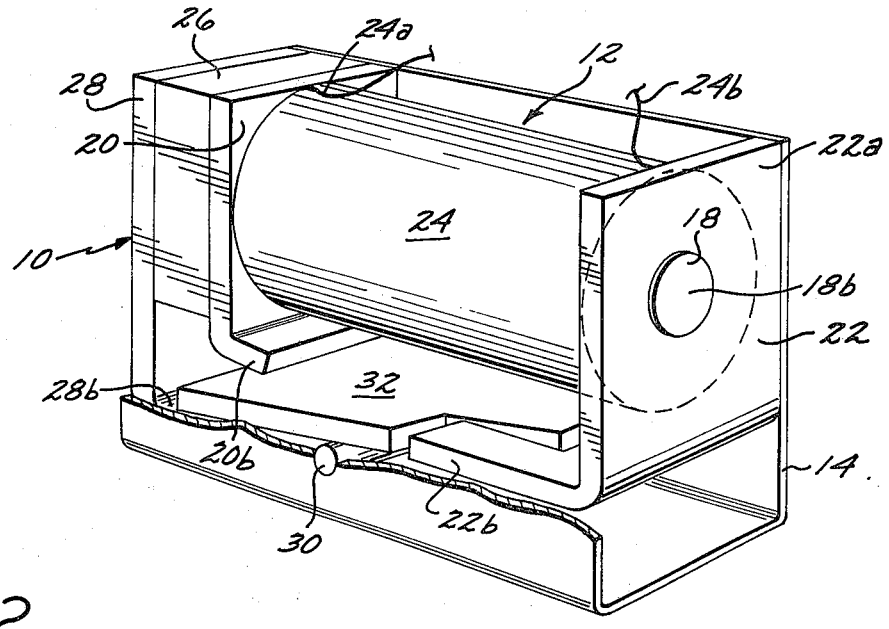
FIG. 1 is a perspective view of a magnetic motor according to the present invention.

Referring to FIG. 1 of the drawings, there is shown therein an electromagnetic relay 10 having a magnetic motor 12 according to the instant invention.

Such relay comprises an outer frame or housing 14 wherein the magnetic motor 12 and switch contact assembly 16 (FIG. 2) are positioned. As will be readily apparent to those persons skilled in the art, the housing 14, as shown, must be of non-magnetic material, and substantially any other type of housing or support means for the various parts may be provided within the context of the present invention.

The magnetic motor 12 comprises an elongated cylindrical core member 18 having opposite end portions **18*a* and 18*b*. Such core member 18** is formed of magnetically permeable material to form a strong and effective portion of the magnetic circuit to be hereinafter described.

Figure 2:
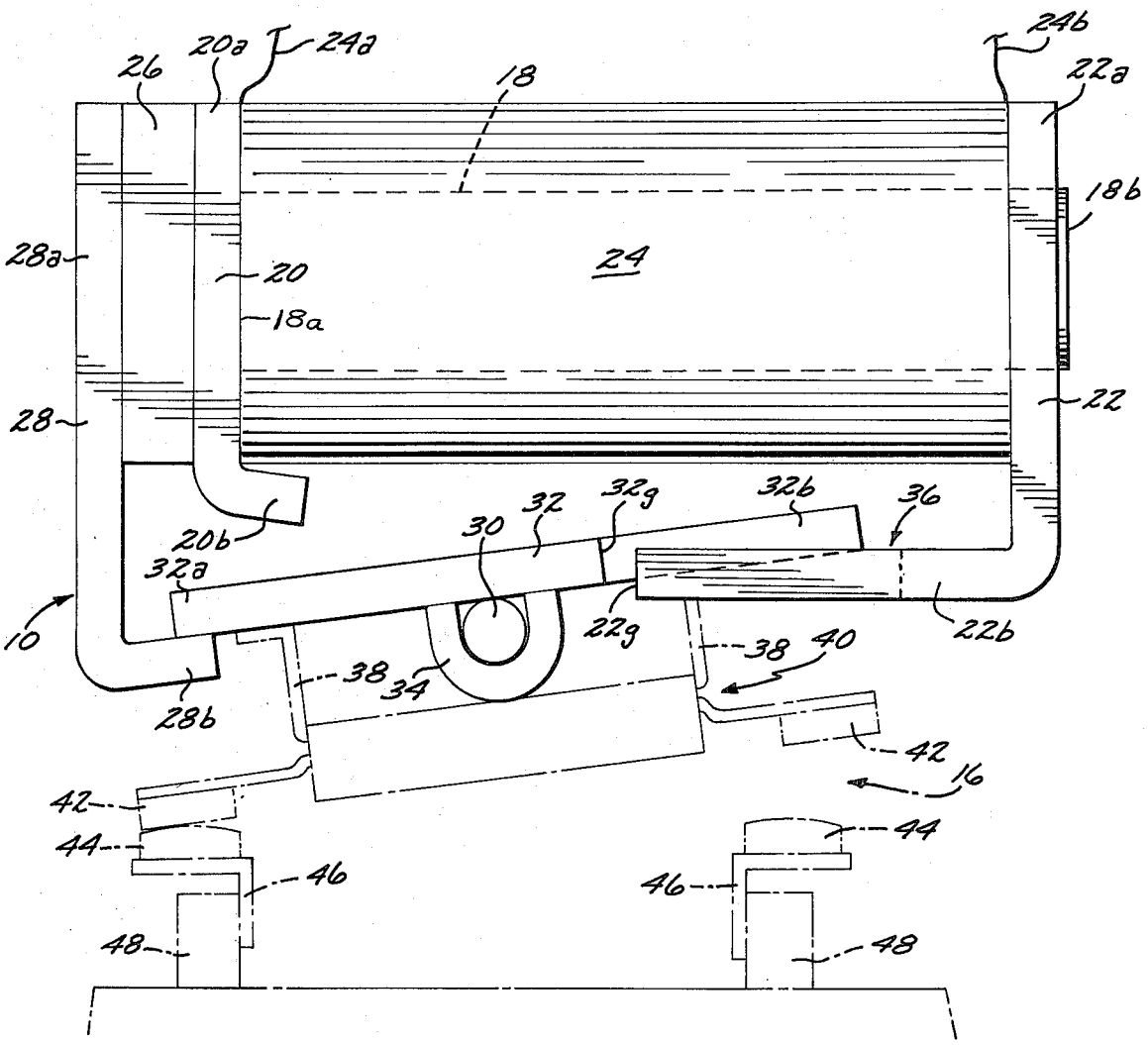
FIG. 2 is a side elevational view of such motor, and electrical contacts controlled thereby.

Secured to end portion **18*a* of core member 18 is a first pole piece 20. It is formed of magnetically permeable material and is provided with an L-shape as shown in FIGS. 2 and 3 of the drawings affording a main portion 20*a* and a contact portion 20*b*. The main portion 20*a* of pole piece 20 is connected to end portion 18*a* of core member 18** in any appropriate fashion such as to ensure effective magnetic flux-conducting relation therebetween.

The opposite end **18*b* of core member 18 carries a second pole piece 22, the latter of which is formed of magnetically permeable material and is provided with a generally L-shape having a main portion 22*a* and a portion 22*b***.

The main portion **22*a* is formed with a through opening for receiving the end portion 18*b* of core member 18** in strong flux-conducting relation.

A control winding 24 is mounted on and about core member 18 and is composed of a plurality of concentric turns of wire which terminate in lead wires **24*a* and 24*b*. As will be readily apparent to those persons skilled in the art, by suitable energization of coil 24, as by connecting lead wires 24*a* and 24*b* across a suitable source of electrical power, the coil 24 is made to generate magnetic flux within core member 18**.

The embodiments shown in the drawings further comprise a permanent magnet 26 positioned against and in flux-conducting relation with the main portion **20*a* of pole piece 20. A third pole piece 28 is firmly secured to permanent magnet 26, and has a main portion 28*a* and a contact portion 28*b*. The contact portion 28*b* is positioned in substantially parallel relation to contact portion 20*b* of pole piece 20**, as shown in the drawings.

The permanent magnet 26 is so positioned between the pole pieces 20 and 28 as to afford magnetic flux flow therebetween.

A pivot support member or pin 30 is provided, and has its opposite end portions suitably positioned within openings in the opposite side walls of U-shaped frame member 14 as shown most particularly in FIG. 1 of the drawings. Such pivot pin 30 carries a relatively flat armature member 32, there being fastening means such as U-shaped brackets 34 for securing said armature to the pivot pin. Pin 30 is preferably formed of non-magnetic material so as to prevent the mounting means therefor, such as frame member 14 or the like, from becoming a part of the permanent or electromagnetic circuitry.

As shown in FIGS. 2 and 3 of the drawings, armature 32 is so mounted with respect to the aforementioned first, second and third pole pieces as to have a first armature end portion 32*a* between contact portions 20*b* and 28*b* of the first and third pole pieces 20 and 28 respectively. In like fashion, the other armature end portion 32*b* is provided for magnetic cooperation with portion 22*b* of the second pole piece 22.

Referring to FIG. 4 of the drawings, armature end portion 32*b* is formed with a generally U-shaped extension 32*c* which fits within a complementally formed cutout 22*c* in end portion 22*b* of pole piece 22. This arrangement provides end portion 32*b* with five substantially flat surfaces 32*c*, 32*d*, 32*e*, 32*f*, and 32*g*, which cooperate with and afford a plurality of magnetic air gaps with substantially flat surfaces 22*c*, 22*d*, 22*e*, 22*f*, and 22*g* on portion 22*b* of pole piece 22. The extension 32*c* is so shaped as to provide an irregular relatively constant, but controlled, air gap 36 between the several parts to thereby provide a strong and predetermined, but consistent, magnetic force between the various parts.

The embodiment of FIG. 5 shows the portion 22*b* of pole piece 22 as having an extension 22*h* and the armature end portion 32*b* as being provided with a complementally formed cutout 32*h*. Thus, the particular shape of such extension and cutout, and the respective parts to which such conditions are applied is immaterial to successful practice of the instant invention. In this regard, it is contemplated that various other shapes of extensions and cutouts could be provided to make an irregular air gap to ensure a strong magnetic attraction between the armature end portion 32*b* and the portion 22*b* of pole piece 22.

As shown most particularly in FIGS. 2 and 3 of the drawings, suitable brackets 38 are secured to the underside of armature 32 to carry a movable contact assembly 40. Such assembly comprises a pair of movable contact members 42 which cooperate with a pair of stationary contacts 44. The latter may be secured to any appropriate mounting means such as L-shaped conductors 46 and supports 48.

The subject magnetic motor shown in the drawings may be employed such that the permanent magnet 26 retains the armature 32 in its position as shown in FIG. 2, with the left hand contacts 42 and 44 in circuit-conducting relation. This condition is then obtained when the electromagnetic coil 18 is de-energized.

Thereafter, upon energization of coil 18, the magnetic flux afforded by permanent magnet 26 is overcome by the electromagnetic flux so as to rotate armature 32 about pin 30 into the position shown in FIG. 3 of the drawings. Under these conditions, the right hand contacts 42 and 44 are placed in circuit-conducting relation as shown in said FIG. 3.

Upon such pivotal movement of armature 32, the end portion 32*a* thereof is permitted to physically engage or contact the respective contact portions 20*b* and 28*b* of the pole pieces 20 and 28, respectively. The end portion 32*b* of armature 32, on the other hand, does not contact the portion 22*b* of pole piece 22, but rather merely moves relative thereto while maintaining the optimum flux-conducting air gap therebetween. Thus, the end portion 32*b* moves betweeen positions on either side of its coplanar relation with portions 22*b* of pole piece 22, such coplanar relation, of course, being the strongest flux-conducting relation therebetween.

With this construction, the end portion 32*b* of armature 32 is never required to contact or engage its cooperating pole piece. Rather, a controlled and effective irregular air gap 36 is maintained therebetween so as to preserve the strength of operation of the permanent magnet or electromagnetic means in controlling the position of armature 32. By utilizing complementally formed irregular shapes to provide the air gap between armature 32 and pole piece 22, the air gap is strengthened and made more effective as well as more consistent throughout the pivotal movement of armature 32.

Although several specific embodiments of the present invention have been shown and described, many modifications thereof are possible, consistent with the invention.

I claim:

1. A magnetic motor comprising in combination, an elongated core member having opposite end portions, a winding on said core member to be electrically energized to afford electromagnetic flux in said core member, a first pole piece fixed to one end portion of said core member, a second pole piece fixed to the other end portion of said core member, a permanent magnet adjacent said second pole piece, a third pole piece adjacent said permanent magnet opposite said second pole piece thereat, and an armature and pivotal support means therefor for pivotal movement of said armature about an axis intermediate first and second end portions thereof, said first armature end portion being substantially coplanar with at least a portion of said first pole piece for magnetic cooperation therewith and said second armature end portion being movable between magnetic cooperation with said second and third pole pieces alternatively, said first armature end portion and said first pole piece being spaced from each other throughout pivotal movement of said armature and being complementally shaped to provide an irregular air gap therebetween.

2. A magnetic motor according to claim 1, wherein said second armature end portion and said second and third pole pieces are positioned for alternative physical engagement of said second and third pole pieces by said second armature end portion upon pivotal movement of said armature about said support means.

3. A magnetic motor according to claim 2, wherein said armature and said first armature end portion are flat and so positioned that said first armature end portion is caused to move substantially equidistant from and on opposite sides of coplanar relation with said first pole piece as said second armature end portion moves from engagement with one of said second and third pole pieces to engagement with the other thereof.

4. A magnetic motor according to claim 3, wherein said first pole piece is formed with a generally U-shaped cutout and said first end portion of said armature is formed with an extension complemental thereto.

5. A magnetic motor according to claim 4, wherein said U-shaped cutout and said extension are reversed on said first pole piece and said first armature end portion.

6. A magnetic motor according to claim 1, wherein said pivotal support means for said armature comprises a transverse pivot pin attached relative to said armature substantially equidistant from said first and second end portions of said armature.

* * * * *